US006783051B2

(12) United States Patent
Kozyrski

(10) Patent No.: US 6,783,051 B2
(45) Date of Patent: Aug. 31, 2004

(54) POINT DRIVER

(75) Inventor: Vincent T. Kozyrski, Plainville, CT (US)

(73) Assignee: The Fletcher-Terry Company, Farmington, CT (US)

( * ) Notice: Subject to any disclaimer, the term of this patent is extended or adjusted under 35 U.S.C. 154(b) by 0 days.

(21) Appl. No.: 10/154,638

(22) Filed: May 24, 2002

(65) Prior Publication Data

US 2003/0132266 A1 Jul. 17, 2003

Related U.S. Application Data

(60) Provisional application No. 60/350,172, filed on Jan. 15, 2002.

(51) Int. Cl.[7] ..... B25C 5/10; B25C 7/00

(52) U.S. Cl. ..... 227/145; 227/119; 227/148; 227/139

(58) Field of Search ..... 227/148, 139, 227/119, 120, 82, 83, 145

(56) References Cited

U.S. PATENT DOCUMENTS

| | | | | | |
|---|---|---|---|---|---|
| 1,366,946 | A | | 2/1921 | Simmons | |
| 1,955,467 | A | | 4/1934 | Morgan | |
| 2,432,853 | A | | 12/1947 | Barclay | |
| 2,482,993 | A | | 9/1949 | Walker | |
| 2,585,939 | A | | 2/1952 | Juilfs | |
| 2,801,415 | A | | 8/1957 | Jenny | |
| 2,910,698 | A | | 11/1959 | Paxton | |
| 3,112,488 | A | * | 12/1963 | Dettloff et al. | 227/127 |
| 3,693,863 | A | | 9/1972 | Black | |
| 3,774,293 | A | | 11/1973 | Golsch | |
| 3,820,705 | A | | 6/1974 | Beals | |
| 3,952,935 | A | | 4/1976 | Erkenbrack | |
| 4,189,082 | A | * | 2/1980 | Solomon | 227/139 |
| 4,296,751 | A | | 10/1981 | Blake, III et al. | |
| 4,349,143 | A | | 9/1982 | Ewig | |
| 4,369,909 | A | * | 1/1983 | Grzeika | 227/147 |
| 4,410,125 | A | * | 10/1983 | Noiles et al. | 227/19 |
| 4,422,567 | A | | 12/1983 | Haynes | |
| 4,491,262 | A | | 1/1985 | Ewig | |
| 4,515,303 | A | | 5/1985 | Schadlich et al. | |
| 4,535,926 | A | | 8/1985 | Furutsu | |
| 4,592,502 | A | | 6/1986 | Judge | |
| 4,611,742 | A | | 9/1986 | Rieker et al. | |
| 4,625,380 | A | | 12/1986 | Everhard et al. | |
| 4,645,111 | A | * | 2/1987 | Larrabee et al. | 227/19 |
| 4,674,669 | A | | 6/1987 | Kozyrski et al. | |
| 4,699,307 | A | | 10/1987 | Kozyrski et al. | |
| 4,763,825 | A | * | 8/1988 | Albin | 227/142 |
| 4,778,094 | A | | 10/1988 | Fishback | |
| 5,076,482 | A | * | 12/1991 | Kozyrski et al. | 227/130 |
| 5,231,750 | A | | 8/1993 | Fealey | |
| 5,261,588 | A | | 11/1993 | Lin | |
| 5,605,270 | A | | 2/1997 | Dunn | |
| 5,816,467 | A | | 10/1998 | Dunn | |
| 5,938,101 | A | * | 8/1999 | Izuchukwu et al. | 227/176.1 |
| 6,098,865 | A | * | 8/2000 | Tebo | 227/147 |
| 6,220,494 | B1 | | 4/2001 | Raffoni | |
| 6,481,613 | B1 | * | 11/2002 | Tebo | 227/147 |

OTHER PUBLICATIONS 1 page equipment flyer—Taurus Equipment Ltd.

* cited by examiner

*Primary Examiner*—Scott A. Smith
*Assistant Examiner*—Gloria R Weeks
(74) *Attorney, Agent, or Firm*—McCormick, Paulding & Huber LLP

(57) ABSTRACT

A point driver is provided that comprises a body, a selectively operable actuator, a pushplate connected to the actuator, and a head. The head includes a channel disposed between a first section and a second section. At least a segment of the channel follows an arcuate path. The head is aligned with the actuator so that a portion or all of the pushplate can be driven by the selectively operable actuator through at least a portion of the channel.

22 Claims, 4 Drawing Sheets

POINT DRIVER

This application claims the benefit of U.S. Provisional Application No. 60/350,172, filed Jan. 15, 2002, which is hereby incorporated by reference in its entirety.

BACKGROUND OF THE INVENTION

1. Technical Field

This invention relates to tools and fluid powered drivers in general, and to tools for driving framer's points, or similar fasteners used for picture framing in particular.

2. Background of the Invention

Artwork, bills, and placards are often mounted within a frame for support and protection. The frame includes an opening surrounded by a rabbetted edge that is open to rear face of the frame. A transparent panel consisting of glass or plastic is positioned contiguous with the rabbetted edge. The artwork, bill, placard or the like, is placed behind the transparent panel. A backing panel is placed on the opposite side of the artwork for protection and support. The glass panel, artwork, and backing panel (i.e., "display panels") are typically held in place by a plurality of glazier's points (sometimes referred to as "framer's" points). Each of the points is driven into the frame contiguous with or in close proximity to the outermost panel to minimize movement of the panels relative to the frame. Some points are rigid and are intended to permanently secure the panels relative to the frame. Flexible points, on the other hand, can be bent aside to permit removal of the panels. Points are relatively small and it is desirable to position them as close as possible to the panels to minimize movement of the panels. Some desirable frame materials are quite hard making it difficult to drive a point into the frame.

To facilitate the job of driving a point, it is known to utilize a mechanically actuated device for driving points. U.S. Pat. No. 4,699,307 is an example of such a driver that is operator powered. Other mechanical drivers utilize a powered actuator (e.g., electrically, pneumatically, hydraulically, magnetically powered, etc.) to drive the point into the framing material.

A critical aspect of any driver is how close it can drive a point to the outermost panel; e.g., the backing board. Ideally, the point is driven into the frame so as to be contiguous with the outermost panel. In reality, however, the point must be supported and guided by the driver as the point is being driven into the frame. The support and guide structure of most prior art drivers includes a nosepiece having a channel through which the point is driven, disposed between a pair of walls. To secure the panels relative to a frame, a lateral surface of the nosepiece is placed on or near the outer most panel and the tip of the nosepiece is placed in contact with the frame. One of the walls of the nosepiece is disposed between the channel and the outermost panel. If the outer surface of the nosepiece wall is skewed from the channel (i.e., a point-shaped nosepiece), the point is driven into the frame skewed and separated from the outermost panel by the thickness of the nosepiece wall. If the outer surface of the nosepiece is parallel to the channel, the point is driven into the frame parallel to the outermost panel, separated from the outermost panel by the thickness of the nosepiece wall. In both instances, the point is likely to be undesirably separated from the outermost panel and must be bent inwardly to achieve the desired effect. Undesirable separation between the point and the outermost panel is particularly problematic for most prior art powered drivers because the size of the actuator (e.g., pneumatic cylinder, coil. etc.) limits how close the driver can be positioned relative to the outer most panel.

What is needed, therefore, is a driver that can drive a point into a frame in close proximity to or contiguous with the outermost of the display panels.

DISCLOSURE OF THE INVENTION

According to the present invention, a point driver is provided that comprises a body, a selectively operable actuator, a pushplate connected to the actuator, and a head. The head includes a channel disposed between a first section and a second section. At least a segment of the channel follows an arcuate path. The head is aligned with the actuator so that a portion or all of the pushplate can be driven by the selectively operable actuator through at least a portion of the channel.

An advantage of the present invention is that a powered point driver is provided that can drive a point into a frame so that substantially all of the exposed point is in close proximity to or contiguous with the outermost panel of display materials. Currently available pneumatically or otherwise powered point drivers typically cannot drive a point into a frame so that substantially all of the exposed point is in close proximity to or contiguous with the outermost panel of display materials. To make the point contiguous with prior art drivers, the operator often must bend the point into contact with the outermost panel.

Another advantage of the present invention point driver is that it can be used to drive both rigid points and flexible points. Prior art drivers operable with flexible points typically support the flexible point via a wall on both sides of a channel through which the point travels to prevent the point from buckling. In such devices, the point is separated from the outermost panel of the display materials by the thickness of the wall. The open channel segment of the present driver, in contrast, provides support that inhibits buckling, yet enables flexible points to be driven into a frame in close proximity to or contiguous with the outermost panel of the display materials.

These and other objects, features, and advantages of the present invention will become apparent in light of the detailed description of the present invention.

DETAILED DESCRIPTION OF THE INVENTION

Figure 1:
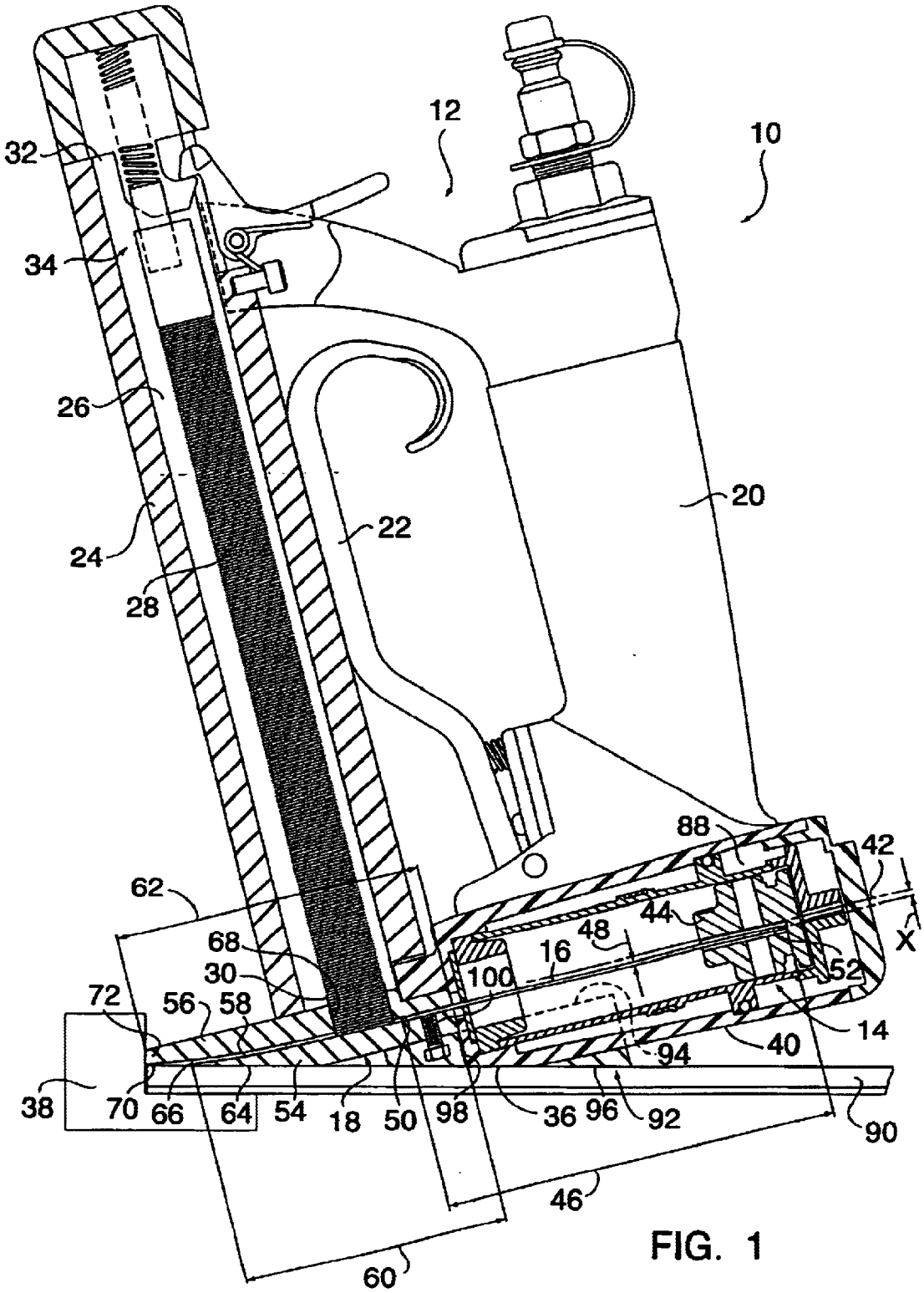
FIG. 1 is a diagrammatic cutaway view of a powered embodiment of the present invention point driver, showing the point driver in a non-actuated position.
Figure 2:
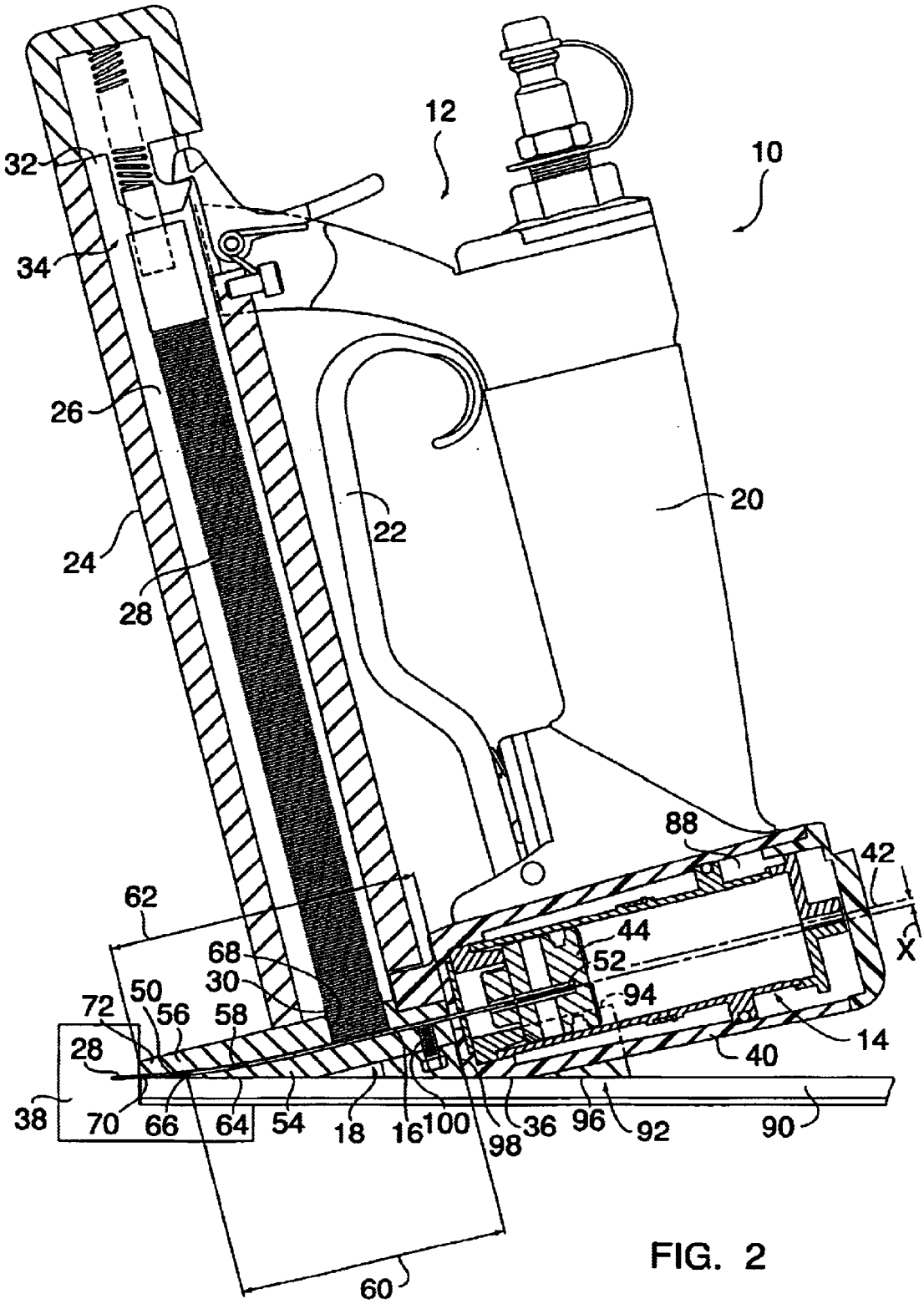
FIG. 2 is a diagrammatic cutaway view of a powered embodiment of the present invention point driver, showing the point driver in an actuated position.
Figure 5:
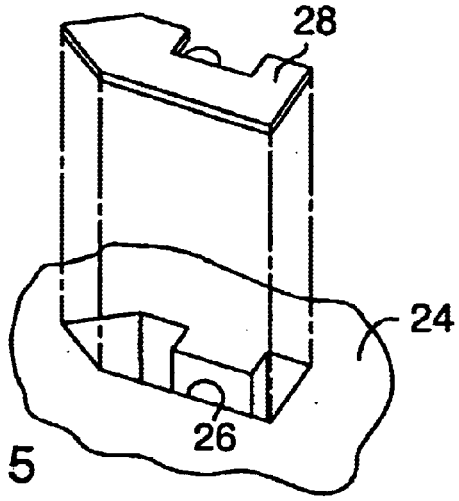
FIG. 5 is a diagrammatic cross-sectional view of a magazine channel and a point.

Referring to FIGS. 1 and 2, the point driver 10 includes a body 12, an actuator 14, a pushplate 16, and a head 18. The body 12 includes a handle 20, a trigger 22, and preferably a magazine 24 for holding points. The magazine 24 includes a channel 26 for receiving a stack of points 28, a chamber end 30, and a loading end 32. The magazine 24 further includes a biasing mechanism 34 for biasing the stack of points 28 within the magazine 24 toward the chamber end 30. The channel 26 has a cross-sectional geometry chosen to accept the shape of the points 28. In some embodiments, the channel 26 cross-sectional geometry (see FIG. 5) may be asymmetrical to ensure the points 28 can only be loaded in a particular predetermined orientation. In some embodiments, the body 12 includes a contact surface 36 disposed adjacent the head 18.

The actuator 14 provides sufficient force and stroke to drive the point 28 from the point driver 10 and into the frame 38 an acceptable amount of penetration. The mechanism used by the actuator 14 to create the sufficient force and stroke can be varied to suit the application. In the embodiment shown in FIGS. 1 and 2, for example, the actuator 14 includes a pneumatically operated cylinder 40 having an axial centerline 42 and a piston 44. The actuator 14 is selectively operated by pressing the trigger 22, which operates a valve arrangement (not shown), connected to the pneumatic cylinder 40. Valve arrangements capable of functionally connecting the trigger 22 and the pneumatic cylinder 40 are well known in the art and therefore will not be further discussed. In other embodiments, the actuator 14 may be electrically, electromagnetically, or hydraulically powered, or may be a mechanically operated type device, or some combination thereof.

The pushplate 16 is a strip-like member that extends along a length 46, a thickness 48, and a width perpendicular to the length 46 and thickness 48. The pushplate 16 embodiment shown in FIGS. 1–4 has a rectangular-shaped widthwise-extending cross-section. Other cross-sectional shapes may be used alternatively. The pushplate 16 extends lengthwise between a first end 50 and a second end 52. The second end 52 of the pushplate 16 is attached to the piston 44 of the actuator 14. In some embodiments, the pushplate 16 is attached to the piston 44 of the actuator 14 at a position offset from the axial centerline 42 of the actuator 14. FIGS. 1 and 2, illustrate a pushplate 16 attached to the piston 44 at a position offset by an amount "X" from the axial centerline 42. The pushplate 16 consists of a resilient material that enables the pushplate 16 to flex during its stroke. The material of the pushplate 16 can be varied to provide whatever mechanical properties are required for an application. Consequently, the pushplate 16 is not limited to any particular material.

The head 18 of the point driver 10 includes a first section 54, a second section 56, and a channel 58 disposed therebetween. The first section 54 has a length 60 and the second section 56 has a length 62, and the length 62 of the second section 56 is greater than the length 60 of the first section 54. The first section 54 includes a contact surface 64 that terminates at one lengthwise end 66 of the first section 54. Contact surface 64 is preferably, but not necessarily, co-planar with contact surface 36. The second section 56 includes an aperture 68 for receiving one or more points 28 disposed within the magazine 24. The aperture 68 extends through the second section 56 and connects with the channel 58. In the embodiment shown in FIGS. 1–4, a surface 70 of the second section 56, disposed adjacent a lengthwise end 72 of the second section 56, is spaced apart from the plane of the contact surface 64 by a distance 74 (see FIG. 3) approximately equal to the thickness of a point 28. The head 18 is connected to the body 12 adjacent the actuator 14. The magazine 24 is connected to the second section 56 of the head 18, aligned with the aperture 68.

Figure 3:
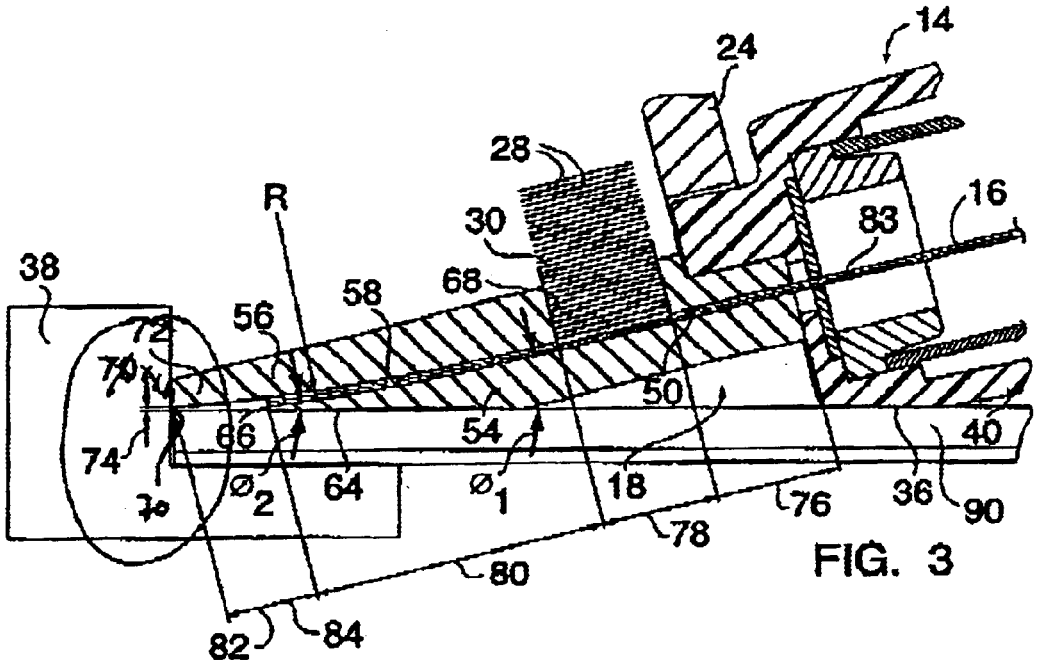
FIG. 3 is a enlarged partial view of the head shown in FIG. 1.
Figure 4:
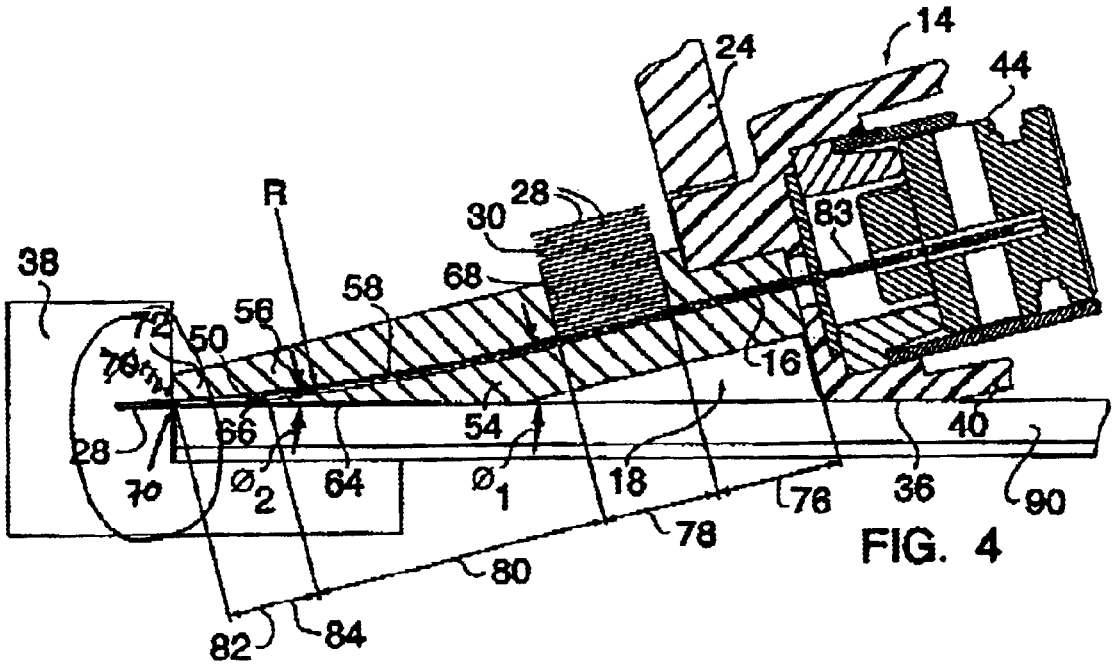
FIG. 4 is an enlarged partial view of the head shown in FIG. 2.

Referring to FIGS. 3 and 4, the channel 58 disposed between the first section 54 and second section 56 includes a guide segment 76, a first segment 78, a second segment 80, and a third segment 82 consecutively positioned; e.g., the guide segment 76 before the first segment 78, the first segment 78 before the second segment 80, etc. The channel further includes a centerline 83. The guide segment 76 is disposed adjacent the actuator 14. In the embodiment shown in FIGS. 1 and 2, the pushplate 16 is received within the guide segment 76 in both the non-actuated position (FIG. 1) and the actuated position (FIG. 2). In alternative embodiments, the guide segment 76 can have a convergent shape that facilitates guiding the pushplate 16 into the first segment 78 of the channel 58. The first segment 78 is aligned with the aperture 68 disposed in the second section 56 of the head 18, and is sized to receive a point 28 from the magazine 24. The second segment 80 is at least partially arcuately shaped. FIGS. 3 and 4 show a portion of the second segment 80 as having a radius "R" for illustrative purposes. The arcuate shape is not, however, limited to a single radius "R". The third segment 82 is open on the side opposite the second section 56 of the head 18. The length 84 of the open third channel segment 82 is chosen to accommodate the length of the point 28 and the anticipated hardness of the frame 38 material, to insure that the point 28 has exited the closed segments of the channel 58. The guide segment 76, first segment 78, and second segment 80, and in some embodiments the third segment 82, are shaped to receive and guide the pushplate 16. The first through third channel segments 78,80,82 are also shaped to receive and guide points 28.

In the guide segment 76 and first segment 78 of the channel 58, the centerline 83 of the channel 58 is substantially straight, extending at a mat angle "$\phi$" from the plane of the contact surface 64. The arcuate portion of the second segment 78 decreases the magnitude of the mat angle "$\phi$" between the centerline 83 of the channel and the plane of the contact surface 64 from "$\phi_1$" to "$\phi_2$", wherein "$\phi_2$" is less than "$\phi_1$". The third segment 82 is an open portion of the channel 58 that is bounded on one side by the second section 56 of the head 18. The first section 54 of the head 18 terminates at the beginning of the third segment 82. The centerline 83 of the channel 58 within the third segment 82 can be arcuate or straight, or some combination thereof.

Figure 6:
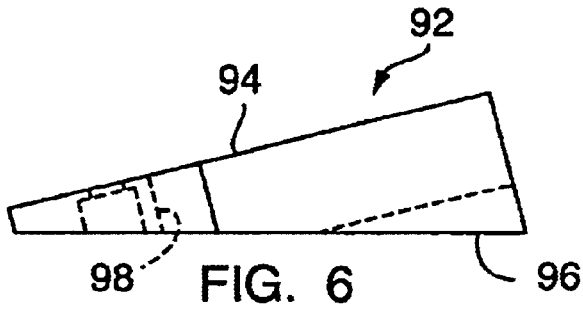
FIG. 6 is a diagrammatic side view of a base embodiment attachable to the point driver.
Figure 7:
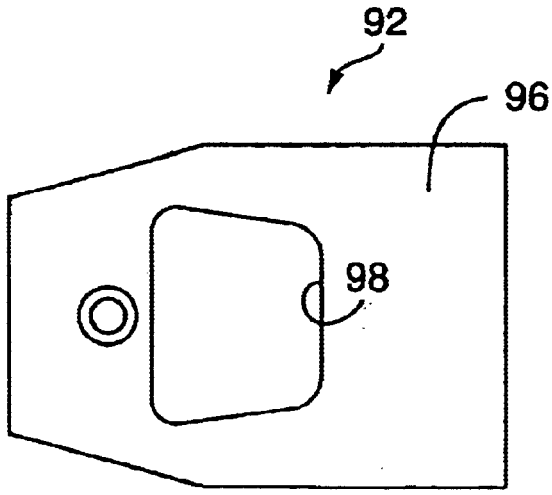
FIG. 7 is a diagrammatic planar view of the base shown in FIG. 6.

Referring to FIGS. 6 and 7, some embodiments of the point driver 10 further include a base 92 to increase the stability of the point driver 10. The base 92 has a top surface 94 and a contact surface 96. The top surface 94 is contoured to receive a portion of the actuator 14. An aperture 98 is disposed in the contact surface 96 to receive the contact surface 36 of the body 12. The contact surface 96 of the base 92 is oriented such that it is substantially coplanar with the contact surface 36 of the body 12 when the base 92 is mounted on the body 12. A fastener 100 (see FIGS. 1 and 2) is used to attach the base 92 to the point driver 10. In an alternative embodiment, the base 92 can be integrally formed with the body 12.

Referring to FIGS. 1–4, in the operation of the point driver 10 a plurality of points 28 are loaded into the magazine 24. As stated above, the present invention point driver 10 can be used with a variety of different shaped points 28 and is, therefore, not limited to use with any particular point 28. In certain applications, however, the magazine 24 can be asymmetrically configured to require points 28 be loaded in a particular orientation (see FIG. 5).

The pushplate 16 is positionable in a non-actuated position as is shown in FIG. 1. In this position, the piston 44 is located adjacent a first end 88 of the actuator 14, and the pushplate 16 is disposed adjacent to or within the guide segment 76 of the channel 58. With the pushplate 16 in this position, a point 28 is disposed in the channel 58. The biasing mechanism 34 biases the stack of points 28 within the magazine 24, thereby causing one of the points 28 to pass through the aperture 68 in the second section 56 of the head 18 and into the first segment 78 of the channel 58. In an embodiment that does not include a magazine 24, a point 28 could also be manually loaded within the first segment 78 of the channel 58.

Pressing the trigger 22 causes the piston 44 within the actuator 14, and therefore the attached pushplate 16, to be driven axially toward the head 18. Within the first segment 78 of the channel 58, the first end 50 of the pushplate 16 contacts the point 28 disposed within the first segment 78 and drives it into the second segment 80. Within the second segment 80 of the channel 58, the resilient pushplate 16 and the point 28 travel through the arcuate portion and thereby change the mat angle at which they are approaching the frame 38 from "$\phi_1$" to "$\phi_2$", wherein "$\phi_2$" is less than "$\phi_1$". The resilient material of the pushplate 16 that gives it flexibility enables the pushplate 16 to travel initially through the straight guide segment 76 and first segment 78, and subsequently through the arcuate second segment 80 without binding. The point 28 subsequently exits the second channel segment 80, passes through the third segment 82, and penetrates the frame 38. The open structure of the third channel segment 82 enables the point 28 to move toward the outermost display panel 90. The surface 70 of the second section 56, disposed adjacent the lengthwise end 72 of the second section 56, advantageously further guides the point 28 to a position that is substantially contiguous and parallel with the outermost panel 90. In some instances, the point 28 may partially intersect with the outermost panel 90.

As described above, the pushplate 16 travels through the entire first and second channel segments 78,80. In alternative embodiments, the stroke of the pushplate 16 can be greater or lesser than that shown in FIGS. 1–4.

Once the actuator 14, and therefore the attached pushplate 16, has reached the end of its stroke, the actuator 14 retracts the piston 44 and pushplate 16 back to the non-actuated position. Once the pushplate 16 has retracted beyond the first segment 78, the biasing mechanism 34 automatically reloads the point driver 10 by biasing another point 28 into the channel 58.

Although this invention has been shown and described with respect to the detailed embodiments thereof, it will be understood by those skilled in the art that various changes in form and detail thereof may be made without departing from the spirit and scope of the invention. For example, the present invention has been described above for use with framer's points 28. The present invention may also be used with other fasteners.

What is claimed is:

1. A point driver, comprising a body;

a selectively operable actuator;

a flexible pushplate connected to the actuator; and a head having a channel disposed between a first section and a second section, wherein at least a segment of the channel follows an arcuate path;

wherein the head is aligned with the actuator so that a portion of the pushplate can be driven by the selectively operable actuator through at least a portion of the channel such that the point being driven travels through at least a portion of the arcuate path.

2. The point driver of claim 1, further comprising an aperture in the second section of the head extending into the channel, wherein a point can be loaded into the channel through the aperture.

3. The point driver of claim 2, wherein the channel further comprises an open segment that is open on a side opposite the second section of the head, and wherein the channel segment that follows an arcuate path is disposed between the aperture that extends into the channel and the open segment of the channel.

4. The point driver of claim 3, wherein a segment of the channel follows a straight path, and the flexible pushplate is driven by the actuator through the arcuate path and the straight path channel segments.

5. The point driver of claim 4, wherein the actuator includes a piston and a centerline, and the flexible pushplate is connected to the piston at a position offset from the centerline of the actuator.

6. The point driver of claim 1, wherein a segment of the channel follows a straight path, and the flexible pushplate is driven by the actuator through the arcuate path and the straight path channel segments.

7. The point driver of claim 6, wherein the channel has a centerline, and the first section of the head includes a mat contact surface;

wherein at one end of the arcuate path segment, the channel centerline is skewed from the mat contact surface by a first mat angle, and at an opposite end of the arcuate path segment, the channel centerline is skewed from the mat contact surface by a second mat angle, and the first mat angle is greater than the second mat angle; and wherein the actuator is selectively operable to drive the flexible pushplate through the straight path segment prior to the arcuate path segment, and return in the opposite order.

8. The point driver of claim 6, further comprising a base having a first contact surface;

wherein the first section of the head includes a second contact surface, and the first contact surface and the second contact surface are substantially co-planer.

9. The point driver of claim 8, wherein the base is attached to the head by a fastener.

10. The point driver of claim 1, wherein the actuator includes a piston and a centerline, and the flexible pushplate is connected to the piston at a position offset from the centerline of the actuator.

11. The point driver of claim 1, wherein the channel comprises consecutively positioned first, second, and third segments, wherein the actuator is operable to drive the pushplate through the first segment toward the second and third segments, wherein an aperture in the second section of the head extends into the first channel segment, and the aperture is sized to permit passage of a point through the aperture and into the channel.

12. The point driver of claim 11, wherein the channel follows the arcuate path within the second segment of the channel.

13. The point driver of claim 12, wherein the third segment is open on a side opposite the second section of the head.

14. The point driver of claim 13, wherein the channel has a centerline, and the first section of the head includes a mat contact surface;

wherein at the end of the second channel segment adjacent the first channel segment, the channel centerline is skewed from the mat contact surface by a first mat angle, and at the end of the second channel segment adjacent the third channel segment, the channel centerline is skewed from the mat contact surface by a second mat angle, and the first mat angle is greater than the second mat angle.

15. A driver for driving points into a substrate, comprising:

a body;

a head, attached to the body, having a channel disposed between a first section and a second section, wherein a segment of the channel is open on a side opposite the second section of the head, and wherein the first section includes a mat contact surface, and the second section includes a guide surface extending substantially parallel to the mat contact surface, the substantially parallel surfaces separated from one another by a distance substantially equal to a thickness of said point;

a selectively operable actuator; and a pushplate connected to the actuator and aligned with the channel;

wherein the guide surface is positioned to guide the point into the substrate so that the point is driven into the substrate substantially parallel to the guide surface.

16. The driver of claim 15, wherein the pushplate is flexible.

17. The driver of claim 16, wherein a segment of the channel follows a straight path and another segment of the channel follows an arcuate path, and the flexible pushplate is driven by the actuator through the arcuate path and the straight path channel segments.

18. The driver of claim 17, wherein the channel has a centerline; and wherein at one end of the arcuate path segment, the channel centerline is skewed from the mat contact surface by a first mat angle, and at an opposite end of the arcuate path segment, the channel centerline is skewed from the mat contact surface by a second mat angle, and the first mat angle is greater than the second mat angle; and wherein the actuator is selectively operable to drive the flexible pushplate through the straight path segment prior to the arcuate path segment, and return in the opposite order.

19. A point driver, comprising:

a body;

a selectively operable linear actuating actuator having a centerline and a piston;

a pushplate connected to the piston at a position offset from the centerline; and a head having a channel disposed between a first section and a second section;

wherein the head is aligned with the offset pushplate so that a portion or all of the pushplate can be driven by the selectively operable actuator through at least a portion of the channel.

20. The point driver of claim 19, wherein a segment of the channel follows a straight path and a segment of the channel follows an arcuate path, and the flexible pushplate is driven by the actuator through the arcuate path and the straight path channel segment.

21. The point driver of claim 20, wherein the channel has a centerline, and the first section of the head includes a mat contact surface;

wherein at one end of the arcuate path segment, the channel centerline is skewed from the mat contact surface by a first mat angle, and at an opposite end of the arcuate path segment, the channel centerline is skewed from the mat contact surface by a second mat angle, and the first mat angle is greater than the second mat angle; and wherein the actuator selectively operable to drive the flexible pushplate through the straight path segment prior to the arcuate path segment, and return in the opposite order.

22. A driver, comprising:

a body;

a selectively operable actuator;

a flexible pushplate connected to the actuator; and a head having a channel disposed between a first section and a second section, wherein the channel include an arcuate path segment and a straight path segment; and wherein straight path segment and the arcuate path segments are positioned so that upon actuation of the point driver, the pushplate encountering a point in the straight path segment will drive the point through the arcuate path segment.

* * * * *